US009225105B2

(12) United States Patent
Cheong et al.

(10) Patent No.: US 9,225,105 B2
(45) Date of Patent: Dec. 29, 2015

(54) WATERPROOF EAR JACK SOCKET AND METHOD OF MANUFACTURING THE SAME

(71) Applicant: Samsung Electronics Co., Ltd., Gyeonggi-do (KR)

(72) Inventors: Hyunmi Cheong, Gyeonggi-do (KR); Uyhyeon Jeong, Gyeonggi-do (KR); Jaeshik Kim, Gyeonggi-do (KR); Kwangjin Bae, Gyeongsangbuk-do (KR)

(73) Assignee: Samsung Electronics Co. Ltd, Suwon-si (KR)

( * ) Notice: Subject to any disclaimer, the term of this patent is extended or adjusted under 35 U.S.C. 154(b) by 0 days.

(21) Appl. No.: 14/213,870

(22) Filed: Mar. 14, 2014

(65) Prior Publication Data

US 2014/0273617 A1 Sep. 18, 2014

(30) Foreign Application Priority Data

Mar. 14, 2013 (KR) ..... 10-2013-0027171

(51) Int. Cl.

| | |
|---|---|
| ***H01R 13/52*** | (2006.01) |
| ***H01R 24/58*** | (2011.01) |
| ***H01R 43/00*** | (2006.01) |
| *H01R 13/504* | (2006.01) |
| *H01R 13/74* | (2006.01) |

(52) U.S. Cl.

CPC ..... *H01R 13/5213* (2013.01); *H01R 13/5208* (2013.01); *H01R 24/58* (2013.01); *H01R 43/005* (2013.01); *H01R 13/504* (2013.01); *H01R 13/74* (2013.01); *Y10T 29/4921* (2015.01)

(58) Field of Classification Search

USPC ..... 439/521, 524, 724, 747, 884, 850, 856, 439/668

See application file for complete search history.

(56) References Cited

U.S. PATENT DOCUMENTS

| | | | | |
|---|---|---|---|---|
| 6,301,489 | B1 * | 10/2001 | Winstead et al. | 455/575.7 |
| 7,481,664 | B1 * | 1/2009 | Knoll et al. | 439/359 |
| 8,531,834 | B2 * | 9/2013 | Rayner | 361/679.56 |
| 8,708,740 | B2 * | 4/2014 | Liou | 439/604 |
| 2010/0313485 | A1 * | 12/2010 | Kuo | 49/484.1 |
| 2011/0195611 | A1 * | 8/2011 | Little et al. | 439/668 |
| 2012/0043235 | A1 * | 2/2012 | Klement | 206/320 |
| 2012/0156907 | A1 * | 6/2012 | Ladouceur et al. | 439/131 |

(Continued)

FOREIGN PATENT DOCUMENTS

| | | |
|---|---|---|
| CN | 202585916 U | 12/2012 |
| CN | 202633641 U | 12/2012 |

(Continued)

OTHER PUBLICATIONS

Extended European Search Report dated Jun. 6, 2014 in connection with European Application No. 14159514.0; 20 pages.

*Primary Examiner* — Alexander Gilman

(57) ABSTRACT

A waterproof ear jack socket includes: an upper socket having at least one slit formed such that a first portion of a contact terminal passes through one surface of the upper socket to be exposed to the outside; a lower socket having a recess for engaging a second portion of the contact terminal on one surface thereof facing the upper socket, the lower socket being coupled to the upper socket to form a plug insertion hole into which an ear jack plug is inserted; and a waterproof cover attached to an outer circumference of a socket body formed by coupling the upper socket and the lower socket.

20 Claims, 10 Drawing Sheets

(56) References Cited

U.S. PATENT DOCUMENTS

| | | | | |
|---|---|---|---|---|
| 2013/0242481 | A1* | 9/2013 | Kim et al. | 361/679.01 |
| 2013/0280961 | A1* | 10/2013 | Cho | 439/660 |
| 2013/0343595 | A1* | 12/2013 | Zorkendorfer et al. | 381/380 |
| 2014/0093116 | A1* | 4/2014 | Liu | 381/384 |
| 2014/0174822 | A1* | 6/2014 | Corona | 174/77 R |

FOREIGN PATENT DOCUMENTS

| | | | |
|---|---|---|---|
| CN | 202737215 | U | 2/2013 |
| JP | 07-226259 | | 8/1995 |
| JP | 2006123458 | A | 5/2006 |
| JP | 2012014863 | A | 1/2012 |

* cited by examiner

WATERPROOF EAR JACK SOCKET AND METHOD OF MANUFACTURING THE SAME

CROSS-REFERENCE TO RELATED APPLICATIONS AND CLAIM OF PRIORITY

The present application is related to and claims the benefit under 35 U.S.C. §119(a) of a Korean patent application filed on Mar. 14, 2013 in the Korean Intellectual Property Office and assigned Serial No. 10-2013-0027171, the entire disclosure of which is hereby incorporated by reference.

TECHNICAL FIELD

The present disclosure relates to a waterproof ear jack socket and a method of manufacturing the same, and more particularly, to a waterproof ear jack socket that is provided with a waterproof function to prevent water from penetrating into a portable terminal, and a method of manufacturing the same.

BACKGROUND

A portable terminal refers to a device carried by a user, and provides a communication function, an electronic note function, a multimedia function, and a broadcast receiving function.

Such a portable terminal generally includes various sockets and connectors for connection to an external speaker and an earphone, connection to an external device such as a personal computer, and mounting of a memory or a SIM card.

The sockets or connectors are generally exposed to the outside as a user connects an earphone or an interface connector to the sockets or connectors if necessary, and include separate covers so that foreign substances cannot be introduced through the sockets or connectors.

Meanwhile, as portable terminals are commonly used, a waterproof function of the portable terminals is gradually gaining interest. Users of portable terminals generally purchase separate waterproof bags if necessary. That is, as long as the waterproof function of portable terminals is not required in everyday lives, users of the portable terminals prevent water penetration of the portable terminals by using waterproof bags only when entering specific facilities. Meanwhile, mountain climbers, soldiers, and people who enjoy aquatic sports or skiing need the waterproof function of portable terminals more.

This is because such users are generally easily exposed to sudden weather changes or bad situations, such that water may possibly penetrate into the portable terminals.

SUMMARY

To address the above-discussed deficiencies, it is a primary object to provide an ear jack socket that prevents water penetration into a portable terminal and a method of manufacturing the same.

The features and technical advantages of the present disclosure will be somewhat widely described so that those skilled in the art to which the present disclosure pertains can easily understand the contents of the present disclosure from a detailed description of the present disclosure. In addition to the features and advantages, the additional features and technical advantages defining the subject of the claims of the present disclosure will be understood more clearly from the detailed description of the present disclosure.

In accordance with embodiments of the present disclosure, a waterproof ear jack socket includes: an upper socket having at least one slit formed such that a first portion of a contact terminal passes through one surface of the upper socket to be exposed to the outside; a lower socket having a recess for engaging a second portion of the contact terminal on one surface thereof facing the upper socket, the lower socket being coupled to the upper socket to form a plug insertion hole into which an ear jack plug is inserted; and a waterproof cover attached to an outer circumference of a socket body formed by coupling the upper socket and the lower socket.

In accordance with embodiments of the present disclosure, a method of manufacturing a waterproof ear jack socket, includes: individually injection molding an upper socket and a lower socket for forming a socket body having a plug insertion hole into which an ear jack plug is inserted; forming at least one slit on one surface of the upper socket such that a first portion of a contact terminal passes through the surface of the upper socket to be exposed to the outside, and forming a recess for engaging an second portion of the contact terminal on one surface of the lower socket facing the upper socket; assembling the contact terminal such that the first portion of the contact terminal is inserted into the slit and the second portion of the contact terminal is engaged with the recess; bonding the upper socket and the lower socket to form the socket body; and insert injection molding around the socket body to form a waterproof cover.

In accordance with certain embodiments of the present disclosure, a waterproof ear jack socket includes: a socket body in which an upper socket and a lower socket that are separately manufactured are coupled to each other to form a plug insertion hole into which an ear jack plug is inserted on a side surface thereof; a waterproof cover enclosing the socket body and in which a resilient portion of a surface of the waterproof cover corresponding to a circumference of an entrance of the plug insertion hole protrudes to be attached to an inner wall of a terminal by a resilient force; and a contact terminal including an upper contact terminal passing through at least one hole formed on an upper surface of the upper socket to be connected to a circuit board of a terminal, and a lower contact terminal integrally formed with the upper contact terminal and inserted into at least one recess formed in the lower socket to contact the ear jack plug.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
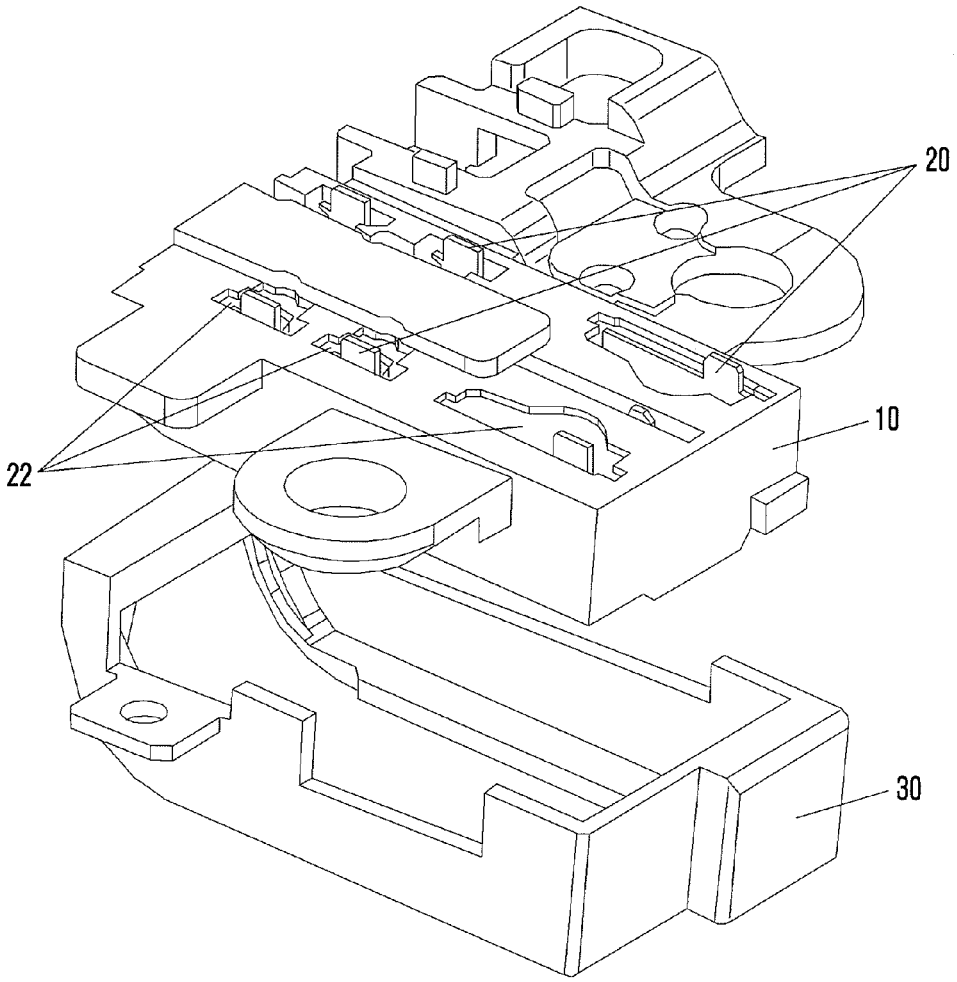
FIG. 1 schematically illustrates a structure of a general ear jack socket.

FIGS. 1 through 10, discussed below, and the various embodiments used to describe the principles of the present disclosure in this patent document are by way of illustration only and should not be construed in any way to limit the scope of the disclosure.

Those skilled in the art will understand that the principles of the present disclosure may be implemented in any suitably arranged wireless communication device. Hereinafter, embodiments of the present disclosure will be described in detail with reference to the accompanying drawings. It is noted that in the drawings, the same elements are provided with the same reference numerals if possible. Further, a detailed description of a configuration of the present disclosure may be omitted herein when it may make the essence of the present disclosure obscure.

In the embodiments of the present disclosure, a portable terminal may apply to all information communication devices and multimedia devices such as a tablet PC, a mobile communication terminal, a mobile phone, a Personal Digital Assistant (PDA), a smart phone, an International Mobile Telecommunication 2000 (IMT-2000) terminal, a Code Division Multiple Access (CDMA) terminal, a Wideband Code Division Multiple Access (WCDMA) terminal, a Global System for Mobile communication (GSM) terminal, a General Packet Radio Service (GPRS) terminal, an Enhanced Data for GSM Evolution (EDGE) terminal, a Universal Mobile Telecommunication Service (UMTS) terminal, a digital broadcasting terminal, and an Automated Teller Machine (ATM), and applications thereof.

FIG. 1 schematically illustrates a structure of a general ear jack socket.

Referring to FIG. 1, the ear jack socket includes an integral socket body 10 into which an ear jack plug (not illustrated) is inserted, contact terminals 20 electrically connecting the plug to a circuit board of the portable terminal, and a cover 30 enclosing the socket body 10.

In the ear jack socket of FIG. 1, the integral socket body 10 should have large holes such that the contact terminals 20 having different shapes and structures at upper and lower sides thereof may be coupled to the socket body 10.

Referring to the exploded view of FIG. 1 illustrating the contact terminal 20, in general, an upper portion 22 of the contact terminal 20 has a small size since it protrudes to the outside of the socket body 10 and contacts the circuit board of the portable terminal, whereas a lower portion 24 of the contact terminal 20 has a relatively large size since it includes a protrusion area facing the plug inserted into the socket body 10 to contact the plug. The size of the contact terminal 20 refers to, for example, a volume of the contact terminal 20.

In order to mount the contact terminal 20 having different sizes at the upper and lower portions 22 and 24 thereof to the integral socket body 10, a hole 40 corresponding to the size of the lower portion 24 of the contact terminal 24 should be formed on one surface of the socket body 10.

However, even if the contact terminal 20 can be mounted all at once through the hole 40 corresponding to the size of the lower portion 24 of the contact terminal 20, a gap may be generated due to the differences in the shapes and sizes of the hole 40 and the upper portion 22 of the contact terminal 20.

Since an interior of the socket body 10 may be exposed to the outside through the gap, water may penetrate into the portable terminal as well as into the socket body 10 through the gap when the portable terminal is submerged in water.

Figure 2:
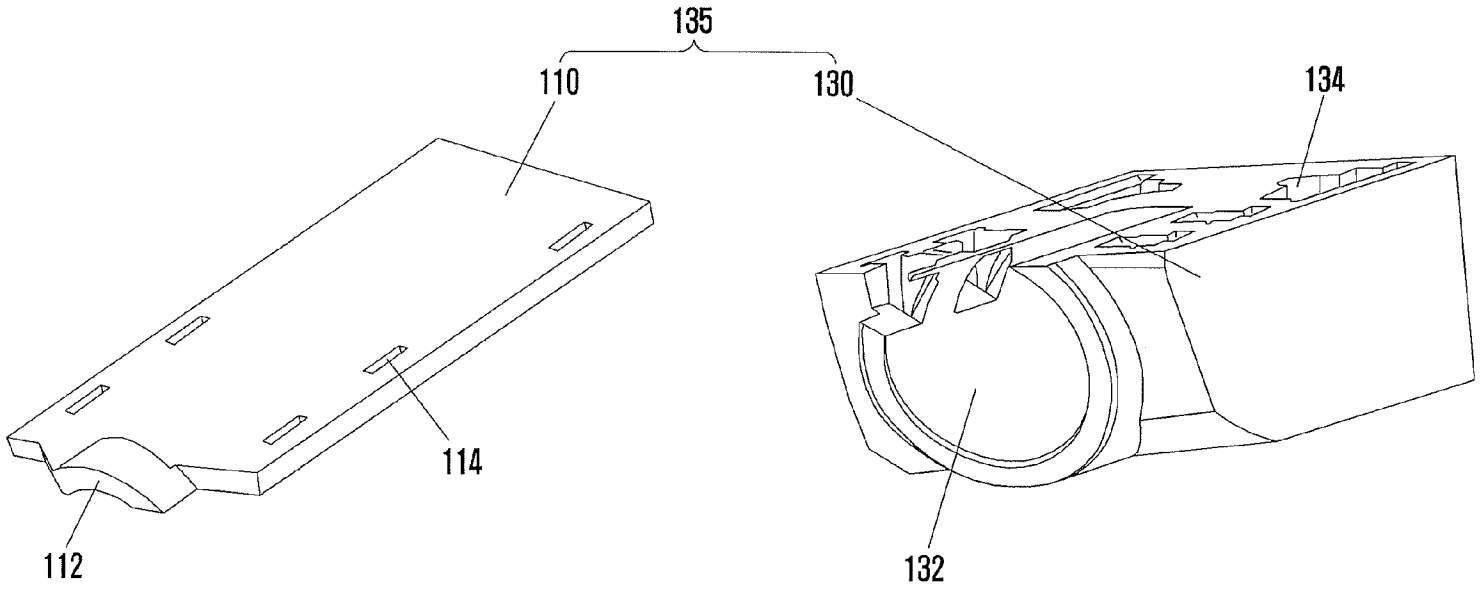
FIG. 2 illustrates schematic views of a structure of a separable socket body of an ear jack socket for a portable terminal in accordance with embodiments of the present disclosure.

FIG. 2 schematically illustrates a separable socket body of an ear jack socket for a portable terminal in accordance with embodiments of the present disclosure.

Referring to FIG. 2, a separable socket body 135 of an ear jack socket for a portable terminal in accordance with the embodiments of the present disclosure includes an upper socket 110 and a lower socket 130.

The upper socket 110 and the lower socket 130 may be formed of at least one of heat-resistant plastic, Polycarbonate (PC), Polyethylene Terephthalate Glycol (PETG), polyethylene (PE), and polypropylene (PP), and may be molded through at least one process of extrusion, blow molding, injection molding, compression, and vacuum forming.

The upper socket 110 has a dome shape at an entrance portion 112 thereof along an outer circumference of an ear jack plug. The entrance portion 112 for insertion of the ear jack plug is a portion of a plug insertion hole.

A plurality of slits 114 for coupling contact terminals 140 to the upper socket 110 later are formed on one surface of the upper socket 110 spaced apart from each other by a predetermined separation. In certain embodiments, the slits 114 have the form of holes through which the contact terminals 140 pass through the upper socket 110 and have appropriate sizes for attachment to and engagement with the contact terminals 140.

One surface of the lower socket 130 is formed to be coupled to the upper socket 110 while facing the upper socket 110, and a portion 132 of the plug insertion hole for insertion of the ear phone plug is formed on a side surface of the lower socket 130.

A plurality of recesses 134 corresponding to the slits 114 formed on one surface of the upper socket 110 are formed on one surface of the lower socket 130 facing the socket 110.

The recesses 134 are formed such that the contact terminals 140 can be vertically inserted into the slits 114 and the recesses 134 at the same time and the contact terminals 140 can be attached to and engaged with the recesses 134. That is, the contact terminals 140 having passed through the slits 114 can be attached to and engaged with the recesses 134.

In accordance with the embodiments of the present disclosure, the upper socket 110 and the lower socket 130 of the socket body 135 are individually injection molded, and the slits 114 and the recesses 134 are formed such that the contact terminals 140 inserted into the upper socket 110 and the lower socket 130 at the same time can be attached to and engaged with the slits 114 and the recesses 134 according to the different shapes of the contact terminals 140, so that a gap is actually not generated between the socket 135 and the contact terminals 140.

That is, in accordance with the embodiments of the present disclosure, since the contact terminals 140 are attached and inserted into the upper socket 110 and the lower socket 130, by reducing the sizes of external holes, moisture can be prevented from penetrating into the portable terminal even when moisture penetrates through the ear jack socket.

Figure 5:
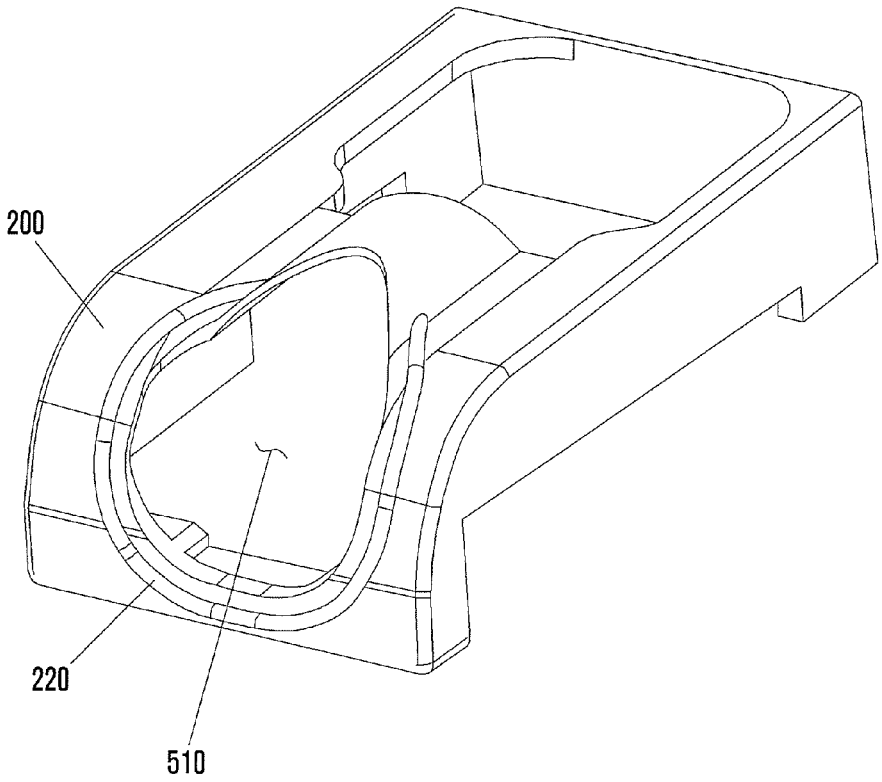
FIG. 5 schematically illustrates a waterproof cover according to embodiments of the present disclosure.

When the upper socket 110 and the lower socket 130 are coupled to each other, the portion 132 of the plug insertion hole of the lower socket 130 is coupled to a portion of the plug insertion hole formed at the entrance portion 112 of the upper socket 110 to completely form a plug insertion hole (see reference number 510 of FIG. 5).

The plug insertion hole (see reference number 510 of FIG. 5) can be closed by a separate lid, and can be opened by detaching the lid if necessary.

Figure 3:
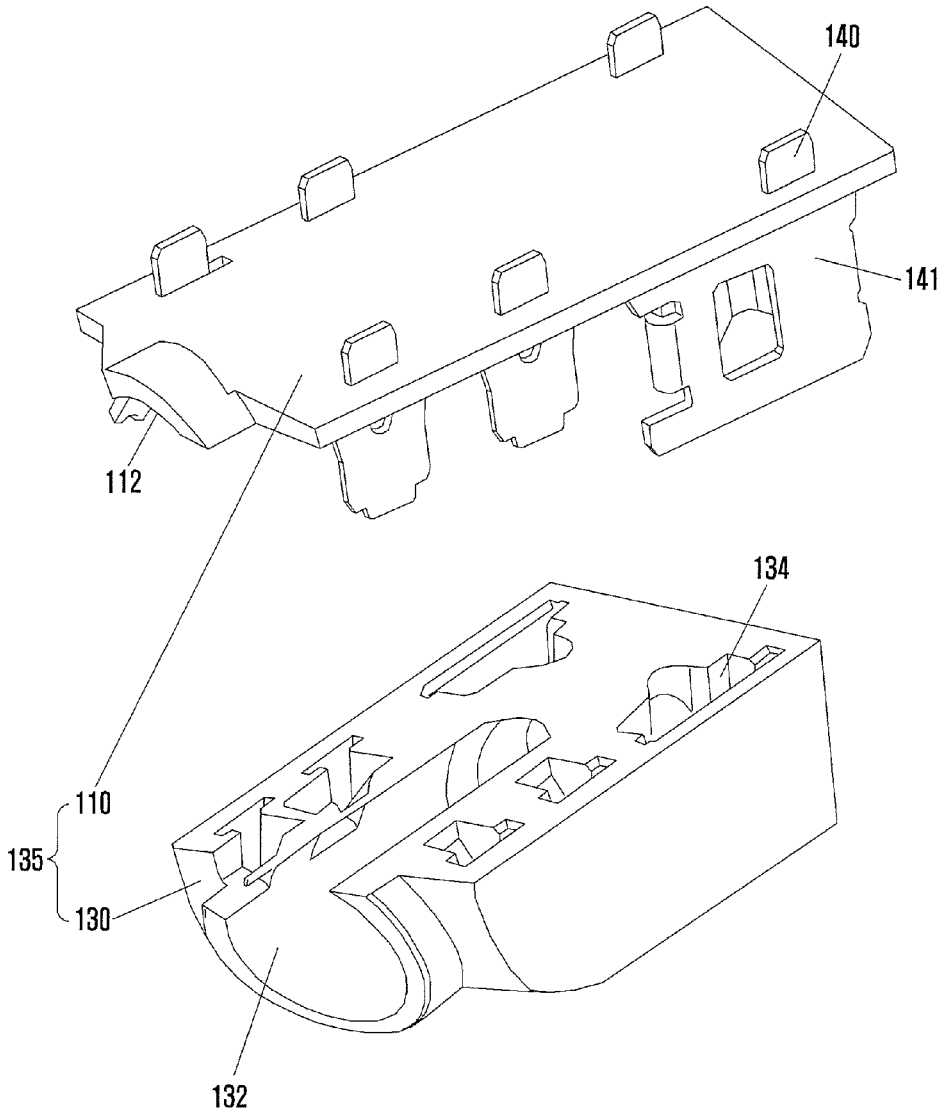
FIG. 3 illustrates perspective views of a process of coupling the separable socket body of the ear jack socket for a portable terminal in accordance with embodiments of the present disclosure.

FIG. 3 illustrates perspective views of a process of coupling the separable socket body of the ear jack socket for a portable terminal in accordance with the embodiments of the present disclosure.

Referring to FIG. 3, the separable socket body 135 of the ear jack socket for a portable terminal in accordance with the embodiments of the present disclosure is formed by coupling the upper socket 110 and the lower socket 130 of the separable socket body 135, by assembling the contact terminals 140 in the slits 114 and the recesses 134 facing the slits 114, and by bonding the upper socket 110 and the lower socket 130.

It can be seen that in accordance with the embodiments of the present disclosure, sizes of holes for insertion of the contact terminals 140 can be reduced as compared with those of the socket body in FIG. 1 by individually injection molding the upper socket 110 and the lower socket 130, and by attaching and inserting the contact terminals 140 into the upper socket 110 and the lower socket 130. That is, since the slits 114 are formed to correspond to the sizes and shapes of the contact terminals 140, a gap is not generated between the contact terminals 140 and the socket body 135 due to the differences between the sizes and shapes thereof.

The contact terminals 140 are terminals for transmitting and receiving audio signals when the ear jack plug is coupled to the ear jack socket. That is, the contact terminals 140 are interfaces for communications between the circuit board of the portable terminal and the ear jack plug. For example, the contact terminals provide paths for transmitting a signal transmitted from an ear microphone of the ear phone to the circuit board. Also, the contact terminals 140 provide paths for transmitting a function sound, an effect sound, and a reception sound generated in the circuit board to the ear jack plug.

For this function, an upper portion of the contact terminal 140 passing through the corresponding slit 114 and protruding upwards extends to the inside of the portable terminal can electrically contact the printed circuit board (PCB). Thereto, a flexible printed circuit board or wiring such as a connection wire can be used.

A lower portion 141 of the contact terminal 140 exposed through a hole 138 formed in an inner wall of the corresponding recess 134 electrically contacts the ear jack plug. That is, the ear jack plug and the exposed portions of the contact terminals 140 directly contact each other through the holes 138 formed in the inner walls of the recesses 134 to be spaced apart from each other. Accordingly, the ear jack plug and an internal circuit of the portable terminal can be electrically connected to each other.

The portions where the contact terminals 140 and the slits 114 contact each other and the portions where the contact terminals 140 and the recesses 134 contact each other can be bonded by using an adhesive or double-sided tapes to reinforce bonding forces.

Figure 4:
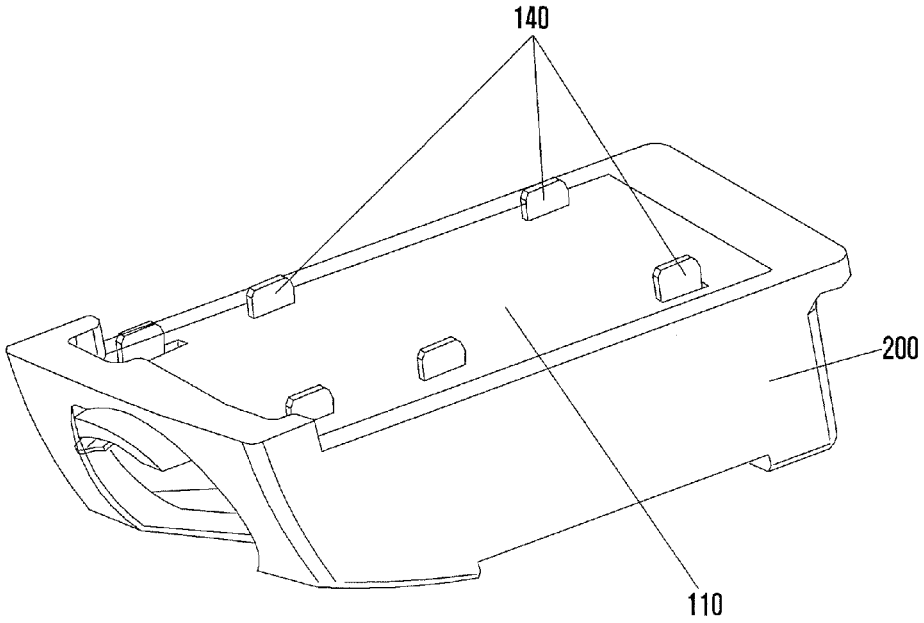
FIG. 4 schematically illustrates a structure in which a waterproof cover is injection molded together with the separable socket body of the ear jack socket for a portable terminal in accordance with embodiments of the present disclosure.

FIG. 4 schematically illustrates a structure in which a waterproof cover is injection molded together with the separable socket body of the ear jack socket for a portable terminal in accordance with an embodiment of the present disclosure. FIG. 5 schematically illustrates the waterproof cover according to the embodiment of the present disclosure.

Referring to FIGS. 4 and 5, the socket body 135 formed by assembling the upper socket 110 and the lower socket 130 and by engaging the contact terminals 140 is injection molded around to form the waterproof cover 200. That is, the waterproof cover 200 is attached to the socket body 135 by placing the socket body 135 into a mold in advance and by injection molding around the socket body 135.

The waterproof cover 200 encloses the socket body 135, and can prevent the socket body 135 from being contaminated or damaged by an external environment and can prevent water from penetrating into the interior of the portable terminal from the outside.

The waterproof cover 200 covers the socket body 135 except for the upper body 110 in which the contact terminals 140 pass through the slits 114 to be exposed to the outside, and the plug insertion hole 510 into which the ear jack plug is inserted, but the structure of the waterproof cover 200 is not limited thereto.

The waterproof cover 200 can be formed by inserting injection molding around the socket body 135 with liquid silicon rubber. An adhesive such as a primer can be applied on an outer surface of the socket body 135 to further increase attachment performance of the waterproof cover 200 and the socket body 135. an adhesive can be further added to the liquid silicon rubber. The integral ear jack socket is formed through the injection molding.

Figure 6:
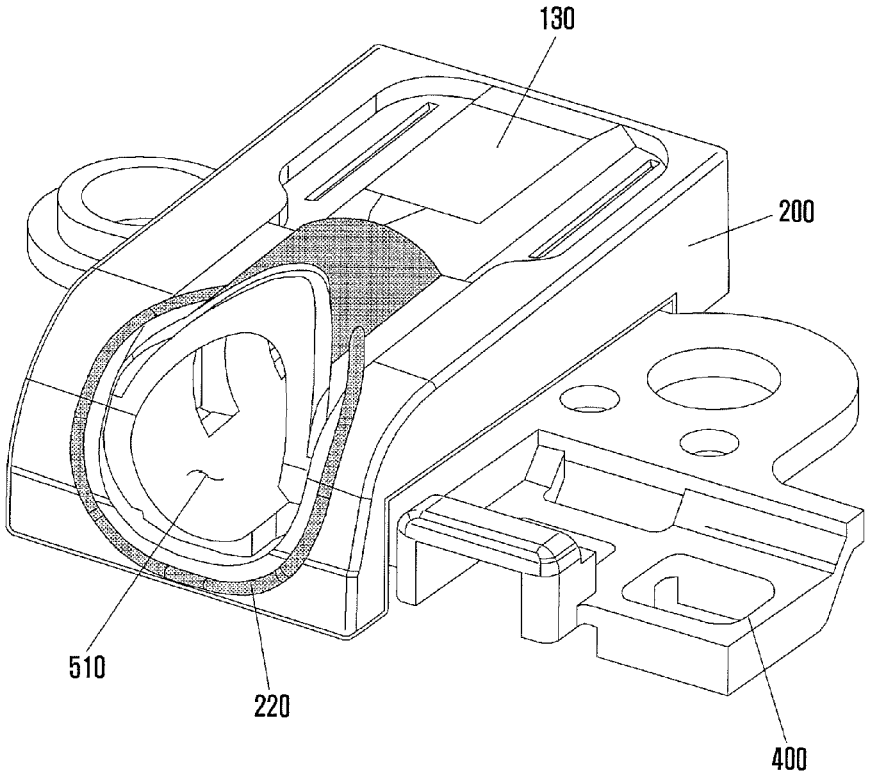
FIG. 6 illustrates a structure in which the waterproof cover is bonded to the separable socket body of the ear jack socket for a portable terminal in accordance with embodiments of the present disclosure.

Referring to FIGS. 5 and 6, a circumference of the waterproof cover 200 adjacent to the plug insertion hole 510 further includes a convex portion 220 protruding by a predetermined height with respect to a surface of the waterproof cover 200. The convex portion 220 is formed of a resilient material such as silicon rubber.

Since the convex portion 220 is attached to an inner wall of the portable terminal by a resilient force while the waterproof cover 200 is mounted within the portable terminal, it can separate the socket body 135 from the outside and thus prevent moisture from being introduced into the socket body 135 when the portable terminal is submerged in water.

The convex portion 220 is formed along a circumference of the plug insertion hole 510 and can be formed to partially cover an outer surface of the lower socket 130 of the socket body 135.

Figure 7:
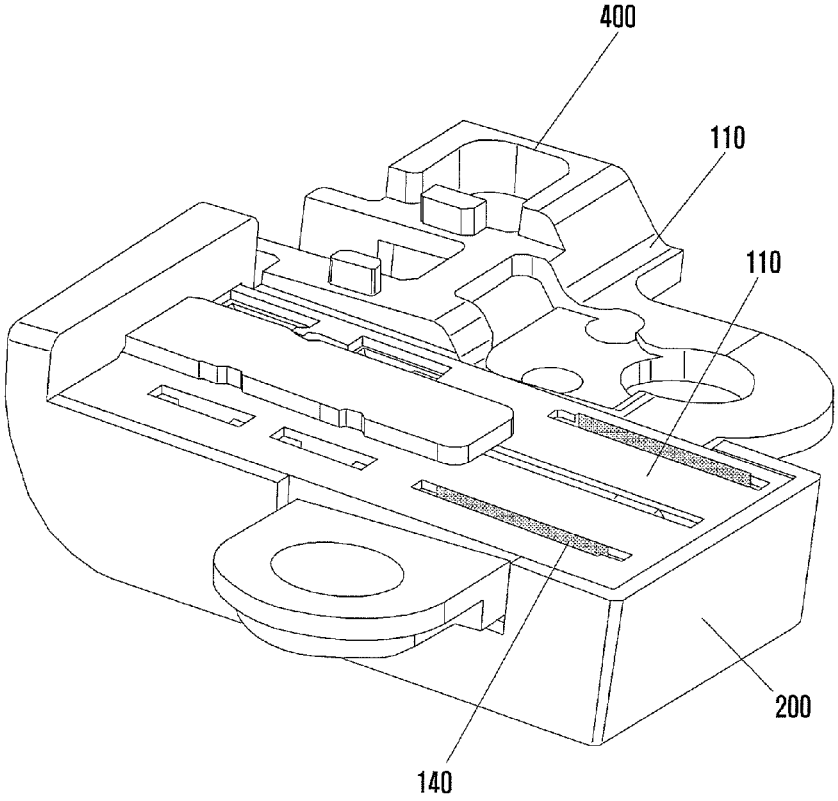
FIG. 7 illustrates a structure of the ear jack socket of FIG. 6 when viewed from the rear side.
Figure 8:
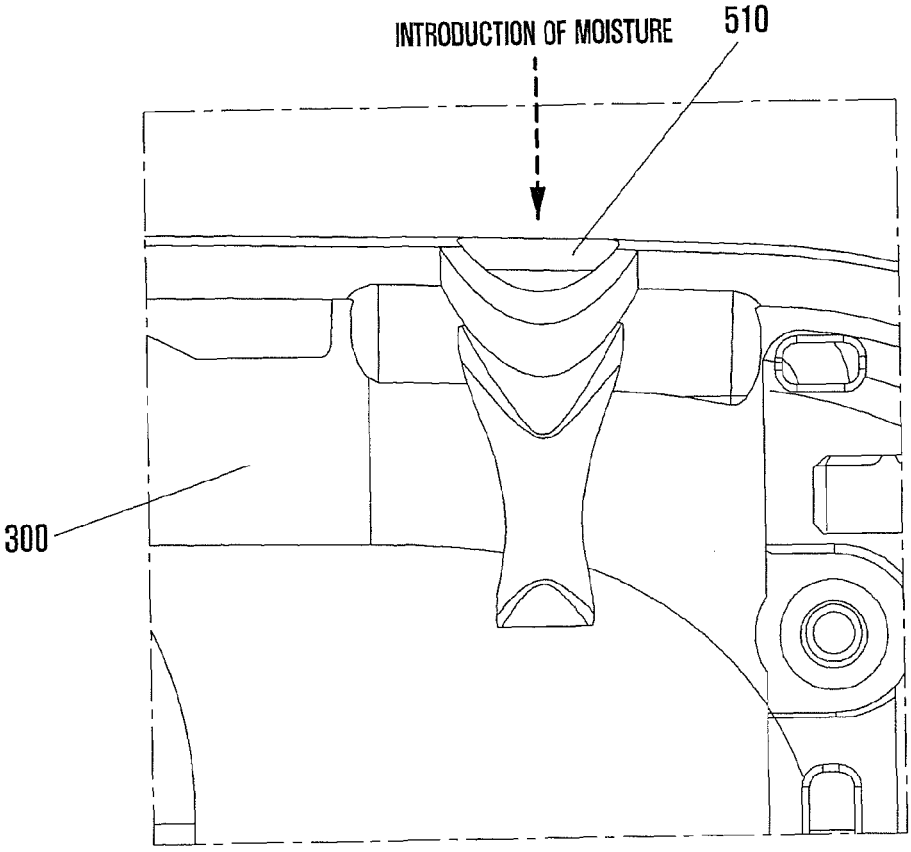
FIGS. 8 and 9 schematically illustrate a structure in which the ear jack socket is mounted within a portable terminal in accordance with embodiments of the present disclosure.
Figure 9:
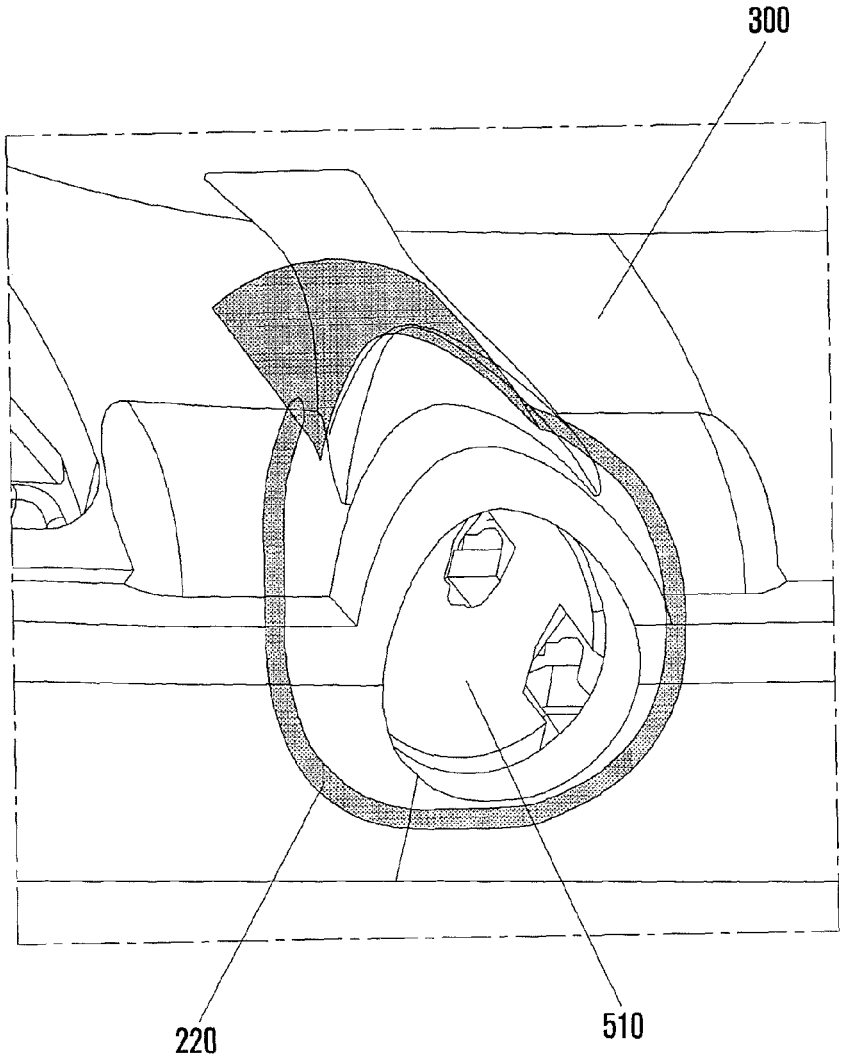

FIG. 6 illustrates a structure in which the waterproof cover is bonded to the separable socket body of the ear jack socket for a portable terminal in accordance with embodiments of the present disclosure. FIG. 7 illustrates a structure of the ear jack socket of FIG. 6 when viewed from the rear side. FIGS. 8 and 9 schematically illustrate a structure in which the ear jack socket is mounted within a portable terminal in accordance with the embodiment of the present disclosure.

The socket body 135 covered by the waterproof cover 200 as illustrated in FIGS. 6 and 7 is mounted to an interior of the portable terminal 300 as illustrated in FIG. 9. An entrance of the plug insertion hole 510 is mounted to be exposed to the outside.

The socket body 135 is injection molded around and is provided with the plug insertion hole 510 for insertion of the ear jack plug. The contact terminals 140 contacting the ear jack plug to transfer an electrical signal to an internal circuit of the portable terminal, but as illustrated in FIGS. 6 and 7, may be injection molded while a structure 400 for mounting other component elements in the portable terminal extends from a portion of the socket body 135.

As illustrated in FIGS. 8 and 9, in the case where the socket body 135 is submerged in water, the socket body 135 can primarily prevent moisture from penetrating into the portable terminal 300 due to the attachment of the convex portion 220 and an inner wall of the portable terminal 300, and can secondarily prevent moisture from penetrating into the portable terminal 300 by individually injection molding the upper socket 110 and the lower socket 130, attaching and inserting the contact terminals 140 into the upper socket 110 and the lower socket 130, and accordingly reducing a size of an external hole.

Figure 10:
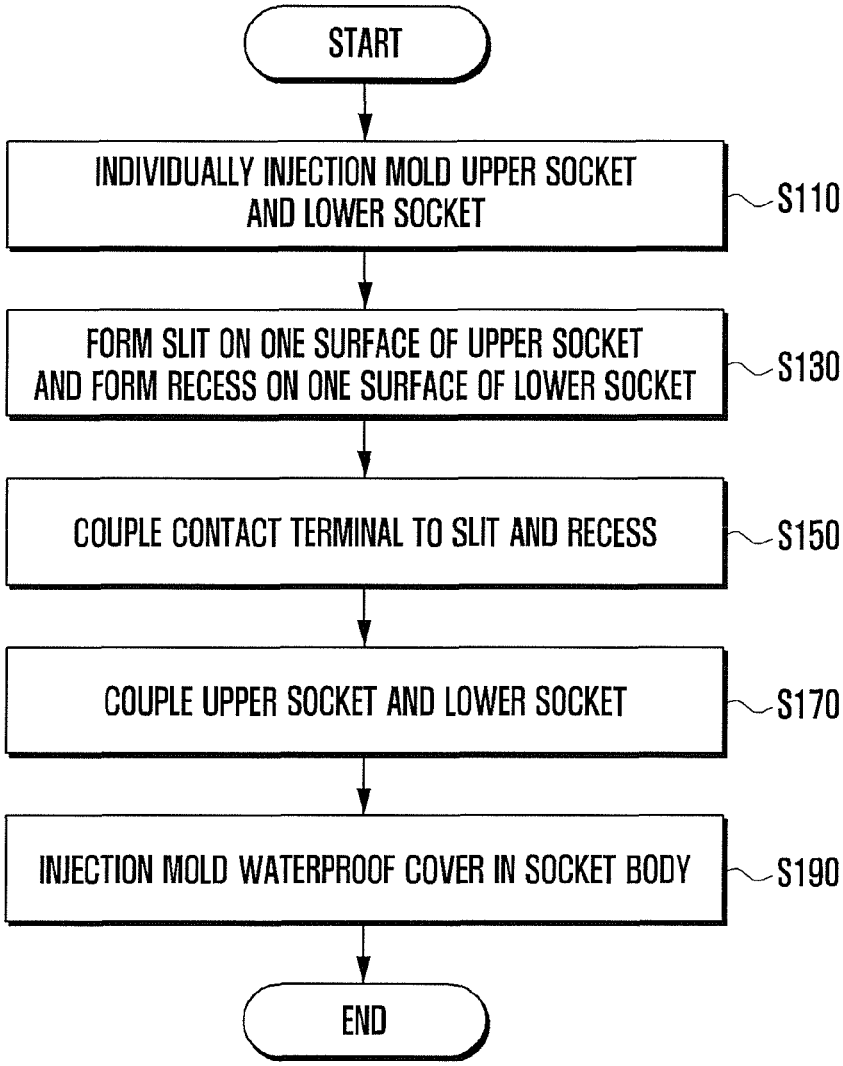
FIG. 10 illustrates a process of manufacturing a waterproof ear jack socket in accordance with embodiments of the present disclosure.

FIG. 10 illustrates a process of manufacturing a waterproof ear jack socket in accordance with an embodiment of the present disclosure.

Referring to FIGS. 10 and 2 to 5, first, in block S110, the upper socket 110 and the lower socket 130 for forming the socket body 135 having the plug insertion hole 510 into which the ear jack plug is inserted are individually injection molded. The upper socket 110 and the lower socket 130 can be formed of at least one of heat-resistant plastic, Polycarbonate (PC), Polyethylene Terephthalate Glycol (PETG), polyethylene (PE), and polypropylene (PP), and can be molded through at least one process of extrusion, blow molding, injection molding, compression, and vacuum forming. The upper socket 110 has a dome shape at the entrance portion 112 thereof along an outer circumference of an ear jack plug. The entrance portion 112 for insertion of the ear jack plug is a portion of a plug insertion hole 510.

Next, in block S130, at least one slit 114 is formed on one surface of the upper socket 110 such that a first portion of the contact terminal 140 can pass through the surface of the upper socket 110 to be exposed to the outside. Also, a recess for engaging a second portion 141 of the contact terminal is formed on one surface of the lower socket 130 facing the upper socket 110. Two or more slits 114 are spaced apart from each other by a predetermined separation in the form of a hole through which the contact terminal 140 passes, and have a size for attachment to and engagement with the contact terminal 140.

Next, in clock S150, the second portion 141 of the contact terminal is engaged with and assembled in the recess 134 by inserting the first portion 140 of the contact terminal 240 into the slit 114.

Next, in block S170, the socket body 135 is formed by bonding the upper socket 110 and the lower socket 130. The upper body 110 and the lower body 130 are bonded to each other by using a double-sided tape or an adhesive, but the present disclosure is not limited thereto.

Next, in block S190, the waterproof cover 200 is formed by insert injection molding around the socket body 135. That is, the socket body 135 is placed into the mold in advance to be insert injection molded around so that the waterproof cover 200 is attached to the socket body 135. The waterproof cover 200 prevents the socket body 135 from being contaminated or damaged by an external environment while enclosing the socket body 135 and can prevent water from penetrating into the portable terminal from the outside at the same time. The waterproof cover 200 covers the socket body 135 except for the upper socket 110 in which the contact terminals 140 pass through the slits 114 to be exposed and except for the plug insertion hole 510 into which the ear jack plug is inserted, but the present disclosure is not limited the structure.

The waterproof cover 200 can be formed by inserting injection molding around the socket body 135 with liquid silicon rubber. An adhesive such as a primer is applied on an outer surface of the socket body 135 to further increase attachment performance of the waterproof cover 200 and the socket body 135. An adhesive can be further added to the liquid silicon rubber. The integral ear jack socket can be formed through the injection molding.

In particular, a circumference of the waterproof cover 200 adjacent to the plug insertion hole 510 can further have a resilient structure protruding by a predetermined height to be attached to the inner wall of the portable terminal by a resilient force, thereby enhancing a waterproof effect.

Accordingly, in the case where the socket body is submerged in water, the socket body can primarily prevent moisture from penetrating into the portable terminal by separating the inner wall of the portable terminal and the ear jack socket structure from the outside, and can secondarily prevent moisture from penetrating into the portable terminal by individually injection molding the upper socket and the lower socket, attaching and inserting the contact terminals into the upper socket and the lower socket, and accordingly reducing a size of an external hole.

Although the present disclosure has been described with embodiments, various changes and modifications may be suggested to one skilled in the art. It is intended that the present disclosure encompass such changes and modifications as fall within the scope of the appended claims.

What is claimed is:

1. A waterproof ear jack socket comprising:

an upper socket having at least one slit formed to allow passage of a first portion of a contact terminal through one surface of the upper socket to be exposed outside the waterproof ear jack socket;

a lower socket having a recess configured to engage a second portion of the contact terminal on one surface thereof facing the upper socket, the lower socket being coupled to the upper socket to form a plug insertion hole into which an ear jack plug is inserted; and a waterproof cover attached to an outer circumference of a socket body formed by coupling the upper socket and the lower socket, wherein the waterproof cover has a convex portion formed of a resilient material and configured to protrude by a predetermined height along a circumference of the waterproof cover adjacent to the plug insertion hole.

2. The waterproof ear jack socket of claim 1, wherein the upper socket has a structure configured to allow passage of the first portion of the contact terminal through the slit while being attached to the slit.

3. The waterproof ear jack socket of claim 1, wherein the lower socket has a structure in which the second portion of the contact terminal is configured to attach to and engage with the recess.

4. The waterproof ear jack socket of claim 1, wherein the convex portion is configured to attach to an inner wall of a portable terminal by a resilient force.

5. The waterproof ear jack socket of claim 1, wherein the upper socket and the lower socket are bonded to each other by one of: a double-sided tape and an adhesive.

6. The waterproof ear jack socket of claim 1, wherein the waterproof cover is formed of liquid silicon rubber.

7. The waterproof ear jack socket of claim 1, wherein the first portion of the contact terminal is configured to pass through the slit and extend into the terminal to electrically contact an internal circuit board.

8. The waterproof ear jack socket of claim 1, wherein the recess has a hole configured to connect a portion of an inner wall of the lower socket to the plug insertion hole.

9. The waterproof ear jack socket of claim 8, wherein the second portion of the contact terminal is configured to be exposed to the plug insertion hole through the hole to electrically contact the ear jack plug.

10. A method of manufacturing a waterproof ear jack socket, the method comprising:

individually injection molding an upper socket and a lower socket for forming a socket body having a plug insertion hole into which an ear jack plug is to be inserted;

forming at least one slit on one surface of the upper socket such that a first portion of a contact terminal passes through the surface of the upper socket to be exposed outside the waterproof ear jack socket, and forming a recess for engaging a second portion of the contact terminal on one surface of the lower socket facing the upper socket;

assembling the contact terminal such that the first portion of the contact terminal is inserted into the slit and the second portion of the contact terminal is engaged with the recess;

bonding the upper socket and the lower socket to form the socket body; and inserting injection molding around the socket body to form a waterproof cover, wherein forming the waterproof cover comprises forming a convex portion of a resilient material, wherein the convex portion protrudes by a predetermined height along a circumference of the waterproof cover adjacent to the plug insertion hole.

11. The method of claim 10, wherein, in the forming of the waterproof cover, the socket body is injection molded around such that the waterproof cover is attached to an outer circumference of the socket body except for the plug insertion hole and one surface of the upper socket from which the contact terminal is exposed.

12. The method of claim 10, wherein, in the forming of the waterproof cover, the waterproof cover is formed by inserting injection molding around the socket body with liquid silicon rubber.

13. The method of claim 10, wherein the forming of the waterproof cover comprises applying a primer on a surface of the socket body before the waterproof cover is injection molded.

14. The method of claim 10, wherein the forming of the waterproof cover further comprises forming the convex portion along the circumference of the waterproof cover adjacent to the plug insertion hole to separate a space of an inner wall of a portable terminal and the waterproof cover from the outside of the waterproof ear jack socket.

15. The method of claim 14, wherein, in the forming of the convex portion, the convex portion is attached to the inner wall of the portable terminal by a resilient force.

16. The method of claim 10, wherein, in the forming of the socket body, the upper socket and the lower socket are bonded to each other using a double-sided tape or an adhesive.

17. A waterproof ear jack socket comprising:

a socket body in which an upper socket and a lower socket that are separately manufactured are coupled to each other to form a plug insertion hole into which an ear jack plug is to be inserted on a side surface thereof;

a waterproof cover enclosing the socket body and in which a resilient portion of a surface of the waterproof cover corresponding to a circumference of an entrance of the plug insertion hole protrudes to be attached to an inner wall of a portable terminal by a resilient force; and a contact terminal comprising an upper contact terminal passing through at least one hole formed on an upper surface of the upper socket to be connected to a circuit board of a terminal, and a lower contact terminal integrally formed with the upper contact terminal and configured to insert into at least one recess formed in the lower socket to contact the ear jack plug.

18. The waterproof ear jack socket of claim 17, wherein the upper contact terminal is configured to pass through the at least one hole of the upper socket while being attached to an inner wall of the at least one hole, and the lower contact terminal is configured to insert into the at least one recess of the lower socket while being attached to an inner wall of the at least one recess.

19. The waterproof ear jack socket of claim 17, wherein the upper contact terminal and the lower contact terminal of the contact terminal have different sizes.

20. The waterproof ear jack socket of claim 17, wherein the waterproof cover is configured to attach to the socket body except for an upper surface of the upper socket and an entrance of the plug insertion hole.

* * * * *